United States Patent [19]

Kobayashi et al.

[11] Patent Number: 4,606,362

[45] Date of Patent: Aug. 19, 1986

[54] CHANGE DELIVERY DEVICE IN COIN SORTING CONTROLLER

[75] Inventors: Osamu Kobayashi; Kouji Yukimoto, both of Kawagoe, Japan

[73] Assignee: Kabushiki Kaisha Nipponcoinco, Tokyo, Japan

[21] Appl. No.: 646,894

[22] Filed: Aug. 30, 1984

[30] Foreign Application Priority Data

Sep. 1, 1983 [JP] Japan ..... 58-134419[U]

[51] Int. Cl.[4] ..... G07D 1/00

[52] U.S. Cl. ..... 133/5 R; 221/273

[58] Field of Search ..... 133/4 R, 4 A, 5 R; 221/273

[56] References Cited

U.S. PATENT DOCUMENTS

| | | | |
|---|---|---|---|
| 3,366,127 | 1/1968 | Breitenstein et al. | 133/4 R |
| 4,080,973 | 3/1978 | Kobayashi | 133/5 R |
| 4,313,450 | 2/1982 | Kirisawa | 133/5 R |

*Primary Examiner*—F. J. Bartuska

*Attorney, Agent, or Firm*—Koda and Androlia

[57] ABSTRACT

A change delivery device in a coin sorting controller, including a change enclosing cylinder, a motion changing mechanism disposed below the change enclosing cylinder for changing a rotational motion into a horizontal reciprocating motion and discharging coins successively by virtue of such reciprocating motion, and a drive unit disposed below the motion changing mechanism for imparting a rotational motion to the latter. It is compact as a whole and ensures a change delivery operation.

1 Claim, 8 Drawing Figures

CHANGE DELIVERY DEVICE IN COIN SORTING CONTROLLER

BACKGROUND OF THE INVENTION (1) Field of the Invention

The present invention relates to a change delivery device in a coin sorting controller having a compact construction and capable of delivering change exactly.

(2) Description of the Prior Art

There has been known a change delivery mechanism, but this known mechanism projects largely in the width direction of a change enclosing cylinder, and therefore a large mounting space is required.

SUMMARY OF THE INVENTION

The present invention has been accomplished in view of the above-mentioned drawback of the prior art, and it is the object thereof to provide a change delivery device in a coin sorting controller free from the above conventional drawback, having a compact construction and capable of performing a change delivery operation in an exact manner.

According to the present invention there is provided a change delivery device in a coin sorting controller including a change enclosing cylinder, a motion changing mechanism for changing a rotational motion into a horizontal reciprocating motion and discharging coins successively by virtue of such reciprocating motion, the motion changing mechanism being disposed below the change enclosing cylinder, and a drive unit for imparting a rotational motion to the motion changing mechanism, the drive unit being disposed below the motion changing mechanism.

DESCRIPTION OF A PREFERRED EMBODIMENT

An embodiment of the present invention will be described in detail hereinunder with reference to the drawings.

The drawings illustrate an auxiliary change delivery device attached to a side wall of a frame of a coin sorting controller having a coin sorting mechanism provided at an upper part of the frame, a plurality of coin enclosing cylinders disposed in parallel below the coin sorting mechanism for enclosing therein by kind coins which have been sorted by the coin sorting mechanism, and a main change delivery mechanism disposed below the coin enclosing cylinders for delivering change in accordance with a command signal. This change delivery device comprises a change enclosing cylinder 1, a motion changing mechanism 2 for changing a rotational motion into a horizontal reciprocating motion and discharging coins successively forward by virtue of such reciprocating motion, the motion changing mechanism 2 being disposed below the change enclosing cylinder 1, and a drive unit 3 disposed below the motion changing mechanism 2 for inparting a rotational force to the latter, the motion changing mechanism 2 and the drive unit 3 being mounted vertically in series with the coin enclosing cylinder 1.

Figure 5:
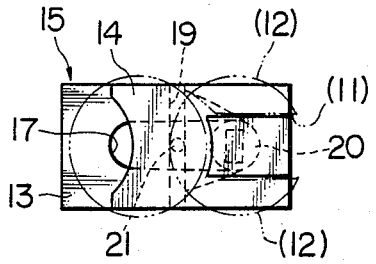
FIG. 5 is a plan view of a motion changing mechanism.
Figure 6:
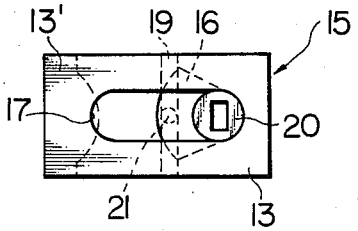
FIG. 6 is a bottom view thereof.

The change enclosing cylinder 1 comprises a pair of axiliary bisected elongated cylindrical portions 1*a* and 1*b*. The rear cylindrical portion 1*b* is pivoted at 4 at a lower part so that it can be opened and closed with respect to the front cylindrical portion 1*a*. Further, a cover 5 is attached horizontally to the upper end of the rear cylindrical portion 1*b*, and it has a pawl 6, which engages the upper end of the front cylindrical portion 1*a*. Thus, a cylindrical body is constituted which is elongated as a whole. In the change enclosing cylinder 1 thus constructed, change coins can be replenished by pivoting the rear cylindrical portion 1*b* backward with the pivot portion 4 as a fulcrum to expose the rear face of the front cylindrical portion 1*a*. The change enclosing cylinder 1 is supported at the lower portion thereof by a holding member 9 mounted on a horizontal portion 8 which is contiguous to an upper part of a vertical portion of an L-shaped support base 7. At the lower portion of the change enclosing cylinder 1 there are provided a pair of change receiving pieces 12 horizontally in a projecting fashion from the lower surface of the holding member 9 and through a gap 10 which corresponds to the thickness of a single coin, the paired receiving pieces 12 being disposed right and left through a slit 11 which opens longitudinally in an intermediate portion as shown in phantom in FIG. 5.

The motion changing mechanism 2 comprises a slide member 15 having a rectangular lower plate 13 which is longer in a longitudinal direction and an upper plate 14 integrally provided above the upper surface of the lower plate 13 in a predetermined spaced relation, and a sectorial pivoting member 16 connected to an output shaft 3' of the drive unit 3. The front edge of the lower plate 13 is extended at 13', and a longitudinally extending guide aperture 17 is formed in a transversely central position. The front edge of the upper plate 14 is recessed arcuately in conformity with the outside diameter of coin, and a projecting portion 18 adapted to be guided longitudinally by the slit 11 is formed on the upper surface of a transversely central rear part of the upper plate 14. Further, a transversely extending recess 19 is formed in the inner surface of the upper plate 14. The pivoting member 16 comprises a sectorial plate having a radius corresponding to approximately one half of the length of the above guide aperture. The pivoting member 16 is provided at its rotational center with a connection 20 which is connected to the output shaft 3' and which slidably engages the guide aperture 17, and also provided on the upper surface of its outer peripheral edge with a pin 21 which engages the recess 19. The motion changing mechanism 2 thus constructed is interposed longitudinally movably between the lower surface of the holding member 9 and a stationary horizontal support plate 22 attached to the support base 7.

The drive unit 3, having a motor and a reduction gear, is mounted below the support plate 22, and its output shaft 3' extends through the support plate 22 and is connected to the connection 20. The numeral 23 denotes a coin conducting member disposed perpendicularly between the inner surface of the vertical portion of the support base 7 and the drive unit 3, the upper portion of the coin conducting member 23 being curved convexly and its end portion fixed to the fore end of the support plate 22. The numeral 24 denotes a handle attached to an upper front face of the change enclosing cylinder 1, and the numeral 25 denotes a carrier switch adapted to be operated by a cam 26 mounted on the output shaft 3.

In the longitudinal direction of the rear cylindrical portion 1*b* are provided a plurality of see-through windows in spaced relation.

Figure 1:
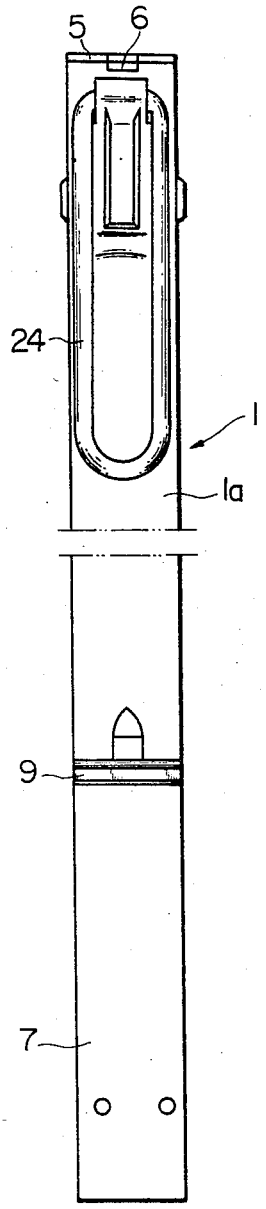
FIG. 1 is a partially cut-away general front view.
Figure 2:
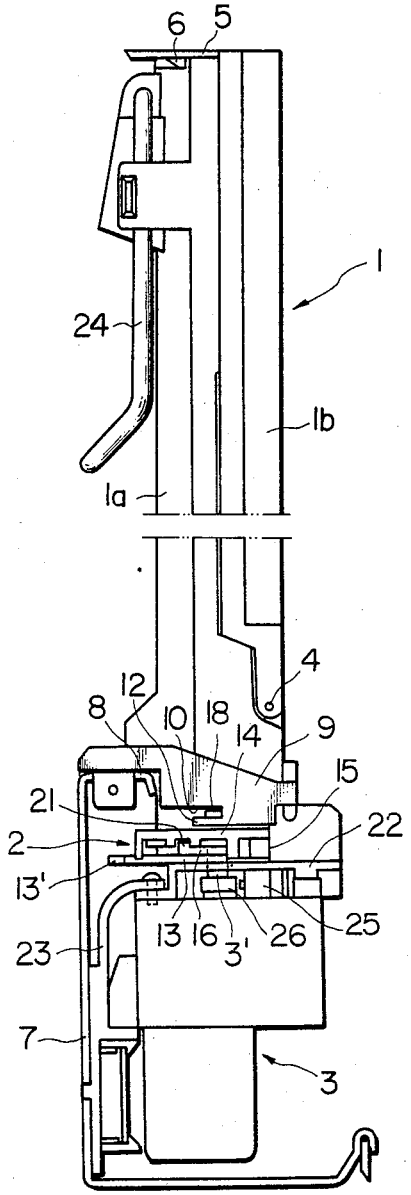
FIG. 2 is a side view thereof.
Figure 3:
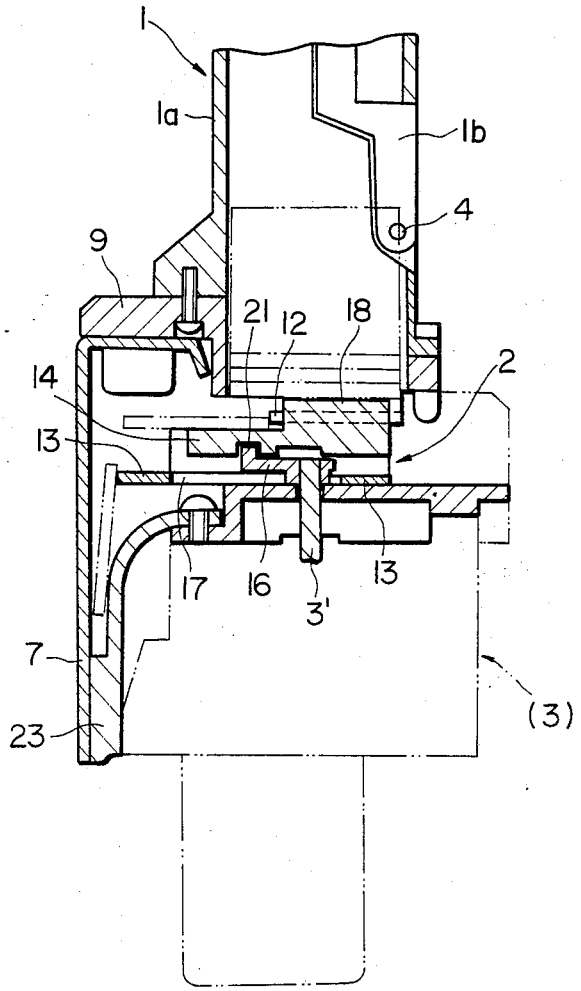
FIGS. 3 and 4 are longitudinal sectional views of a principal portion, showing operating conditions.

In a change delivery stand-by state, as shown in FIG. 3, the connection 20 is positioned at the rear end of the guide aperture 17, and the slide member 15 is in the most advanced state, with the pin 21 being positioned intermediately of the guide aperture 17, while the coins enclosed in the change enclosing cylinder 1 are stacked on the projecting portion 18 and a single coin for delivery is placed on the upper plate 14.

Figure 4:
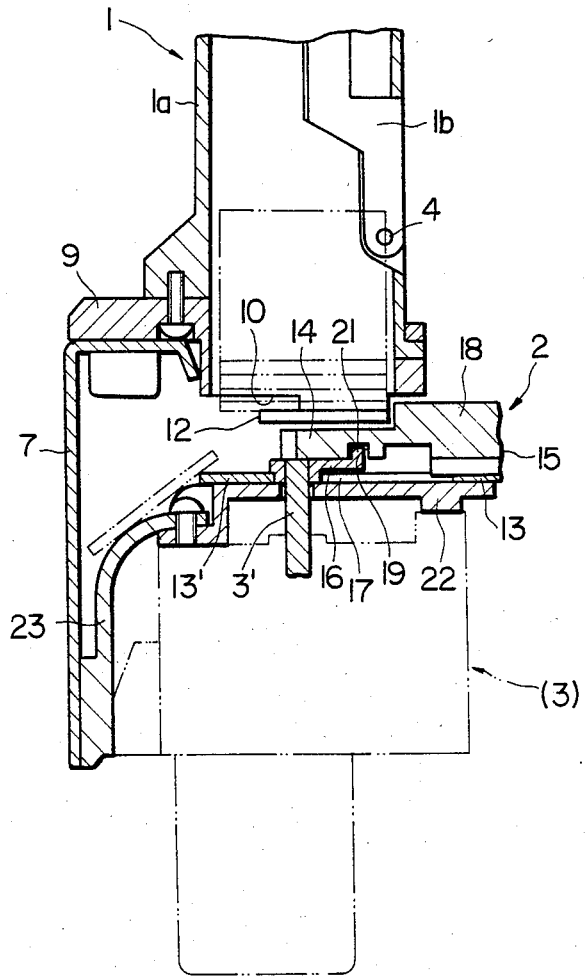
Figure 7A:
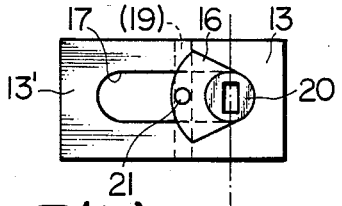
FIGS. 7(*a*) and 7(*b*) are plan views showing the relationship between a cam piece and a lower slide plate.
Figure 7B:
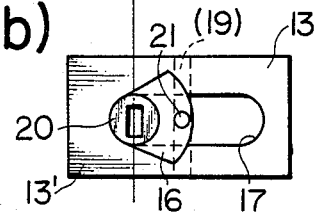

In this state, as the drive unit 3 rotates in accordance with a change command signal, the pivoting member 16 connected to the output shaft 3' of the drive unit rotates, and when it has rotated 180 degrees, the connection 20 is positioned at the fore end of the guide aperture 17 and the slide member 15 is in the most retreated state, with the pin 21 being positioned intermediately of the guide aperture 17, as shown in FIG. 4. More particularly, the lower plate 13 moves from the position shown in FIG. 7(*a*) up to the position shown in FIG. 7(*b*). In this case, as the slide member 15 moves back, the coin on the upper plate 14 is prevented from retreating by the front edge of the receiving plates 12, and it is conducted and discharged to the change return side through the upper curved portion of the coin conducting member 23 while being inclined downward by the front edge of the upper plate 14 and that of the extension 13' of the lower plate 13. At the same time, in a fully retreated state of the slide member 15, one coin in the change enclosing cylinder 1 is put on the receiving piece 12. Then, with the subsequent half rotation of the pivoting member 16, the projecting portion 18 advances along the slit between the paired receiving pieces 12. This advancing motion causes one coin on the receiving pieces 12 to be pushed out forward, and in a fully advanced state of the slide member 15 the coin is put on the upper plate 14 of the slide member 15, thus reverting to the change delivery stand-by state shown in FIG. 3.

In this way, change coins are discharged successively at a rate of one per rotation of the output shaft 3' of the drive unit 3.

According to the present invention, as set forth hereinabove, the motion changing mechanism for changing a rotational motion into a horizontal reciprocating motion and discharging coins successively by virtue of such reciprocating motion is disposed below the change enclosing cylinder, and the drive unit for imparting a rotational motion to the motion changing mechanism is disposed below the latter, and thus these components are mounted vertically in series with each other. Consequently, unlike the conventional device in which a change delivery mechanism projects largely in the transverse direction of a change enclosing cylinder, there can be provided a coin changer which is compact as a whole so does not require a large mounting space and which ensures a change delivery operation.

What is claimed is:

1. A change delivery device and a coin sorting controller, comprising:

a motion changing mechanism for changing a rotational motion into a horizontal reciprocating motion and discharging coins successively by virture of said reciprocating motion, said motion changing mechanisms being disposed below a change enclosing cylinder, said change enclosing cylinder being provided at the lower portion thereof through a gap with a pair of change receiving pieces which are opposed right and left to each other and said motion changing mechanism comprises a slide member and a sectorial pivoting member, said slide member having an upper plate and a lower plate, said upper plate having a longitudinally extending projecting portion formed on the upper surface thereof and adapted to move between said paired change receiving pieces, said upper plate having a transversely extending recess formed in the lower surface thereof, said lower plate having a longitudinally extending guide aperture, said sectorial pivoting member being interposed between said upper and lower plates of said slide member and provided at an outer marginal part of its upper surface with a pin which engages said recess of said upper plate and also being provided at an upper end part of its inner surface with a connection which engages said guide aperture of said lower plate; and a drive unit for imparting a rotational motion to said motion changing mechanism, said drive unit being disposed below said motion changing mechanism, said drive unit having an output shaft connected to said connection.

* * * * *